United States Patent [19]

Kowal

[11] 4,389,872

[45] Jun. 28, 1983

[54] TUBE BENDER CONSTRUCTION

[75] Inventor: Leonard J. Kowal, Prospect Heights, Ill.

[73] Assignee: Imperial Clevite Inc., Rolling Meadows, Ill.

[21] Appl. No.: 229,862

[22] Filed: Jan. 30, 1981

[51] Int. Cl.[3] ..... B21D 7/02

[52] U.S. Cl. ..... 72/388; 72/36

[58] Field of Search ..... 72/459, 458, 457, 388, 72/387, 217, 149, 461, 32, 33, 34, 35, 36

[56] References Cited

U.S. PATENT DOCUMENTS

| | | | |
|---|---|---|---|
| 1,889,239 | 11/1932 | Crowley | 72/388 |
| 2,796,785 | 6/1957 | Philippe | 72/388 |
| 2,887,917 | 5/1959 | Kowal | 72/388 |
| 2,955,495 | 10/1960 | Stirling | 72/36 |
| 3,194,038 | 7/1965 | Small | 72/459 |
| 3,236,082 | 2/1966 | Beck | 72/149 |
| 3,433,042 | 3/1969 | Crihfield | 72/217 |
| 3,750,447 | 8/1973 | Kowal | 72/459 |
| 3,926,028 | 12/1975 | Kowal | 72/388 |

*Primary Examiner*—Gene Crosby

*Attorney, Agent, or Firm*—Wood, Dalton, Phillips, Mason & Rowe

[57] ABSTRACT

A tube bender construction for manual operation in bending a tube. The tube bender includes a mandrel defining a bending groove into which the tube is urged by a forming member mounted to the mandrel to swing about a bending axis of the bending groove. The tube to be bent is held against longitudinal movement during the bending operation by tube-holding structure arranged to clamp the tube against an extended groove portion of the mandrel. Movement of the forming member about the bending axis is effected by manipulation of a pair of handles which are arranged in offset manner to permit crossover of the handles and avoid interference between the user's hands thereon in the tube bending operation.

13 Claims, 7 Drawing Figures

TUBE BENDER CONSTRUCTION

BACKGROUND OF THE INVENTION

1. Field of the Invention

This invention relates to tube benders and in particular to manually operable tube benders wherein a forming member is swung about a mandrel axis by means of a handle associated therewith and a handle mounted to the mandrel.

2. Description of the Background Art

Manually operable tube benders are well known in the art. One improved form of such tube bender is illustrated in U.S. Pat. No. 2,796,785 of Howard L. Philippe. As shown therein, a shoe forming member is provided with a handle. The shoe is swingably mounted to a mandrel for pivotal movement about a bending axis. The mandrel is provided with an angle scale on its front face. A second handle is connected to the mandrel. A hook is swingably mounted on the second handle for engaging the tube at a point adjacent the bend start point of a groove in the periphery of the mandrel into which the tube is urged in the bending operation.

Further improved tube benders are illustrated in U.S. Pat. No. 2,887,917 and 3,926,028 of the inventor herein. In U.S. Pat. No. 2,887,917, a tube bender is illustrated wherein the handle connected to the mandrel is provided with an offset and improved scale means are provided on the mandrel front face for indicating the extent of the formed bend.

In Kowal U.S. Pat. No. 3,926,028, the tube bender is provided with a vise mounting portion in lieu of the handle secured to the mandrel. In one form, the hook is formed integrally with the male clamp portion, and in a second form, the hook is pivotally mounted thereon. Cooperating scale means are provided on the mandrel front face and forming member.

In U.S. Pat. No. 3,750,447 of the inventor herein and William R. Saddler, a further improved tube bender is illustrated having fixed hook means with a cutout space being provided in confrontation to the hook to permit facilitated installation of the tube to be bent into the tool, notwithstanding the fixed relationship of the hook to the mandrel. Cooperating scale means are provided on the front face of the mandrel and the forming member.

SUMMARY OF THE INVENTION

The present invention comprehends an improved manually operable tube bender construction having improved means for automatically positioning a tube to be bent therein.

More specifically, the invention comprehends the provision of shoulder, or stop, means positioned to be abutted by a portion of the tube to be bent spaced from the bend start point a preselected distance. The shoulder may be utilized to permit forming of a plurality of tubes on a repeatable basis without the need to premeasure and mark the tubing.

The shoulder means may be adjustably mounted on a support carried by the mandrel of the tube bender. Alternatively, the shoulder means may be permanently fixedly mounted to the mandrel.

Where the shoulder means is adjustably mounted, the mounting support may be provided with scale calibrations, programmed distance markings, etc., for use in effecting the desired bending operations.

In one form, the shoulder means is provided with angular calibrations so as to permit alignment of a bend preformed in the tube to extend at a desired angle to the plane of the mandrel bending groove. The angular calibration means includes a zero angle indication so as to provide an indication of an alignment of a preformed bend with the mandrel bending groove.

The invention further comprehends the provision of scale means on the mandrel cooperating with the conventional scale means on the front face thereof for indicating the movement of the forming member from the opposite face of the mandrel.

In the illustrated embodiment, the markings on the rear face of the mandrel have less angular extent than those on the front face, and in the illustrated embodiment, only major angular indications are provided in the scale on the rear face.

More specifically, the invention comprehends the provision in such a manually operable tube bender of positioning means carried by the mandrel for providing a stop spaced from the bending groove bend start position an accurately preselected distance for abutment by a portion of the tube to be bent therewith to accurately cause the bend to be spaced accurately from the portion.

In the illustrated embodiment, the positioning means includes a support fixedly connected to the mandrel and a stop element adjustably mounted on the support.

Further more specifically, in one form, the stop is provided with indicia indicating angular positions about the axis of the portion of the tube to be bent at the bend start position, whereby a preformed bend may be positioned in abutment with said stop and disposed in preselected angular relationship to the arcuate extent of the bending groove.

Futher more specifically, in the illustrated embodiment, the first scale means are provided on the front face of the mandrel and the second scale means are provided on the rear face of the mandrel, and means are associated with the forming member cooperating with said scales for indicating the angular disposition of the forming member relative to the bend start position.

In the illustrated embodiment, more specifically, means are provided for preventing movement of the forming member from the bend start position in the direction opposite to the direction of extent of the scales therefrom whereby the forming member may be readily positioned at the bend start point without need for observation of the scales and the means associated with the forming member.

BRIEF DESCRIPTION OF THE DRAWING p

Other features and advantages of the invention will be apparent from the following description taken in connection with the accompanying drawing wherein.

DESCRIPTION OF THE PREFERRED EMBODIMENT

Figure 1:
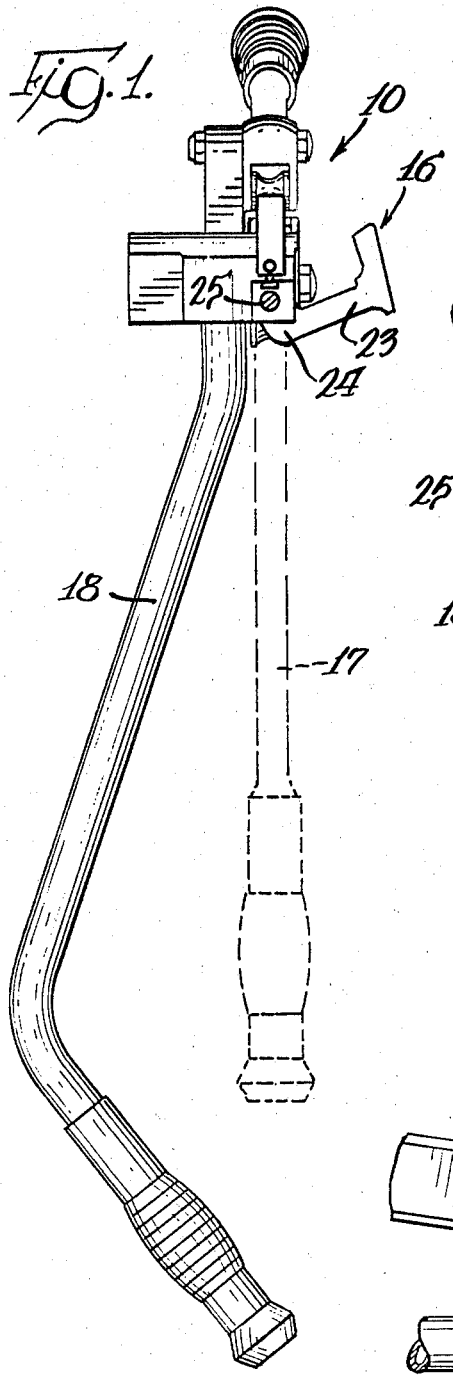
FIG. 1 is an elevation of a tube bender embodying the invention.

In the exemplary embodiment of the invention as disclosed in the drawing, a manually operable tube bender generally designated 10 is shown to include a mandrel 11 defining an annular peripheral bending groove 12. A tube to be bent T is bent into the forming groove by a forming member 13 which is swung about a bending axis 14 of the groove 12 by its connection to the mandrel through a link 15. The tube to be bent is held against longitudinal movement during the bending operation by a holding means generally designated 16.

Movement of the forming member 13 about axis 14 is effected by suitable manipulation of a pair of handles 17 and 18 connected respectively to the forming member 13 and mandrel 11.

Figure 2:
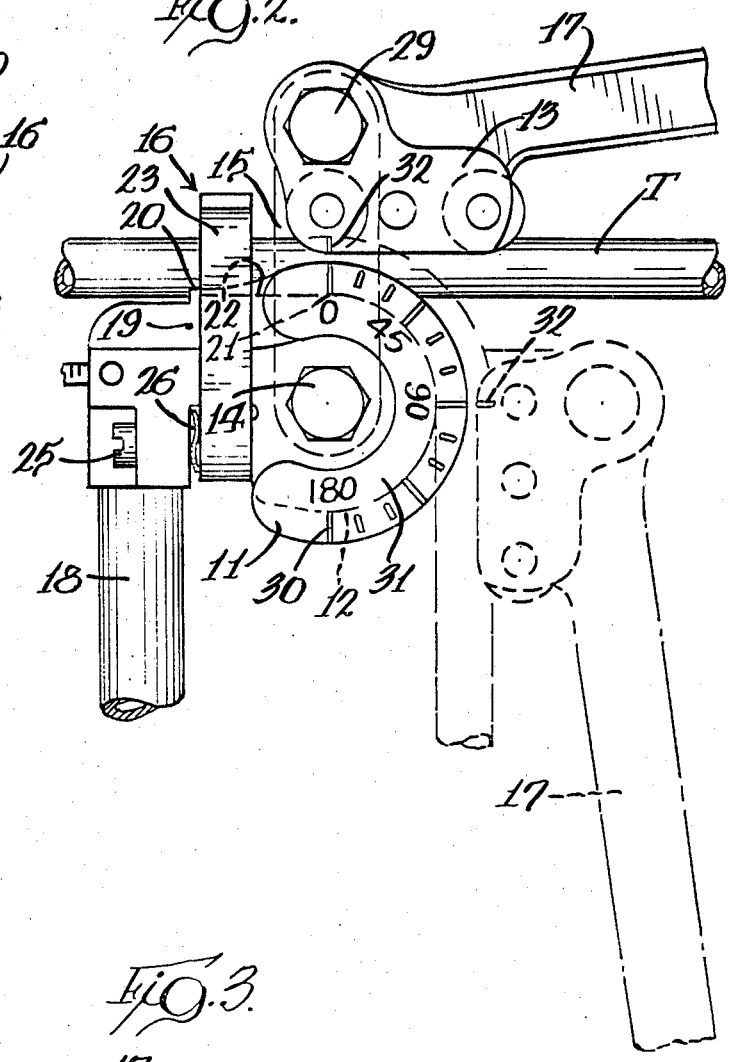
FIG. 2 is a fragmentary side elevation thereof with the forming member shown in a 90° bend position in broken lines.

As best seen in FIG. 2, mandrel 11 defines an integral extension 19 which further defines an integral extension 20 of the bending groove 12 of the mandrel. As shown, bending groove extension 20 extends from the bend start point 21 rectilinearly to adjacent the holding means 16 and, thus, defines means for receiving the rectilinear tube T to be bent and holding the tube in position for coaction with the holding means 16. While the groove extension extends rectilinearly, the depth thereof may decrease outwardly toward holding means 16, as illustrated in the FIG. 2 illustration of the top 22 of the edges of the groove defined by the mandrel extension portion 33.

More specifically, as seen in FIG. 1, holding means 16 is defined by a hook 23 having a connecting portion 24 pivotally mounted to mandrel 11 by a pivot screw 25. A spring washer 26 may be provided for providing frictional retention of the hook against free swinging on the pivot pin.

Figure 3:
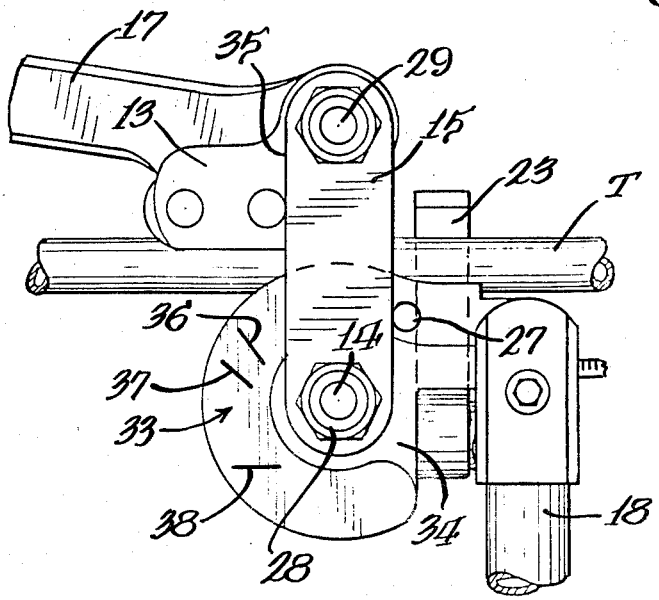
FIG. 3 is a fragmentary rear elevation thereof illustrating the second scale means on the rear face of the mandrel.

As shown in FIG. 3, link 15 abuts a stop pin projecting from the rear face 28 of the mandrel when the forming member 13 is brought to the bend start position illustrated in FIGS. 2 and 3. Link 15 is pivotally connected to the mandrel to swing about axis 14 by a pivot screw 28 and is pivotally connected to handle 17 by a pivot screw 29, as shown in FIG. 3.

As shown in FIG. 2, the disposition of forming member 13 in the bend start position is determined by reference to a scale 30 carried on the front face 31 of the mandrel and a cooperating indicium 32 carried on the forming member 13. The amount of bend effected by movement of the forming member 13 about the circumference of the mandrel is indicated by the marker 32 relative to scale 30, such as illustrated in broken lines in FIG. 2, wherein a 90° bend is shown.

As indicated briefly above, the invention comprehends the provision of a second scale 33 on rear face 34 of the mandrel. Link 15 defines a leading edge 35 serving as a cooperating indicator relative to scale 33 for indicating the angular movement of the forming member 13 from the bend start position to a number of different angular positions, such as a 30° angular position indicated by scale marking 36, a 45° position as indicated by scale marking 37, and a 90° position such as indicated by scale marking 38, when link edge 35 is aligned therewith.

Thus, scale 33 cooperates with the link edge 35 in providing to the user an indication of the tube bend from the rear face of the mandrel without need for turning the tool so as to present the front face thereof to the user at all times.

In the illustrated embodiment, scale 33 has an angular extent less than that of scale 30 on the front face of the mandrel and has a smaller number of markings. As will be obvious to those skilled in the art, other scale and cooperating indicator means may be utilized within the scope of the invention.

Figure 4:
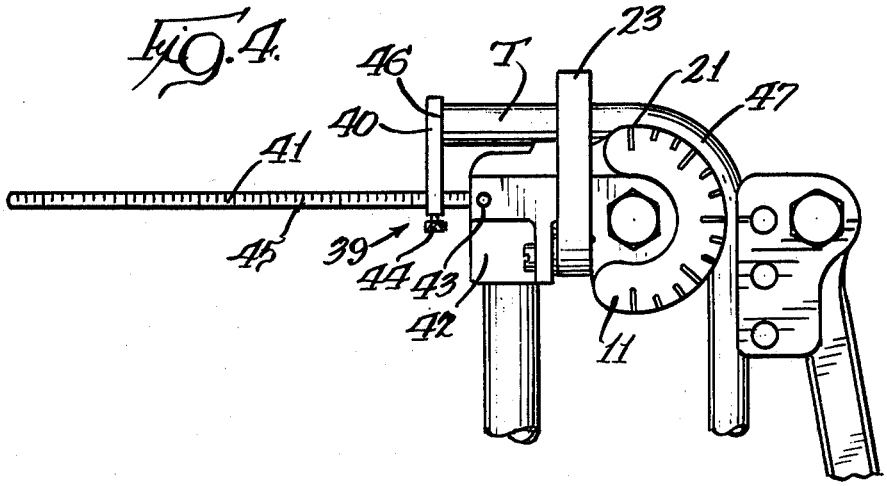
FIG. 4 is a fragmentary side elevation illustrating one form of the tube stop means embodying the invention.

Referring now to the embodiments of FIGS. 4–7, the invention further comprehends the provision of an improved stop means generally designated 39 for automatically positioning the tube T relative to the bend start point 21. As shown in FIG. 4, a stop member 40 is adjustably mounted on a rod support 41 removably secured to an extension 42 of the mandrel 11 by suitable means, such as set screw 43. Stop member 40 may be adjustably locked to the support rod by a suitable threaded clamp screw 44 of conventional construction.

As shown in FIG. 4, the support rod may be provided with suitable indicia 45 for indicating the position of stop 40. In the illustrated embodiment, indicia 45 comprises a scale for indicating the spacing of the stop 40 from the bend start point 21 so as to automatically provide an abutment for the end 46 of the tube T and thereby define means for providing the desired bend 47 in the tube T at a preselected distance from the end of the tube.

Figure 5:
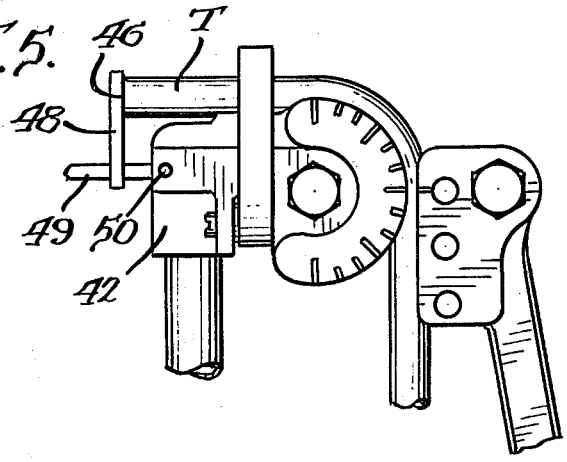
FIG. 5 is a fragmentary side elevation illustrating the provision of another form of the tube stop means embodying the invention.

Referring to the embodiment of FIG. 5, the invention further comprehends the provision of a stop member 48 fixedly on a support 49 removably secured to the mandrel extension 42 by a set screw 50. Thus, where the forming operations are intended to be conducted with a large number of tubes T, each having the bend spaced from the tube end 46 a preselected distance, such a permanently fixed tube stop may be utilized in lieu of the adjustable tube stop of the stop means 39.

Alternatively, indicia 45 of stop means 29 may comprise a programmed plurality of scale markings. Thus, the user need merely adjust the stop member 40 to each of the different scale markings to provide a preselected series of different tube spacings from the bend start point.

Figure 6:
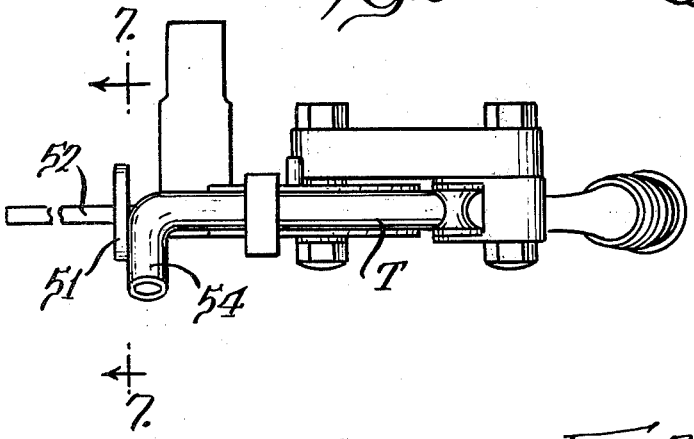
FIG. 6 is an end elevation illustrating the provision of still another form of tube stop means embodying the invention.
Figure 7:
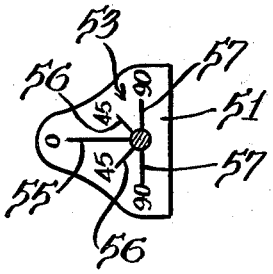
FIG. 7 is a transverse section taken substantially along the line 7—7 of FIG. 6.

Referring to the embodiment of FIGS. 6 and 7, the stop member 51 carried on the stop support 52 may comprise a plate having angle scale means 53 such as for use in indicating the angular extent of a preformed bend 54 in the tube T spaced from the bend start point a preselected distance, as determined by the location of the stop member 51 on support 52. In the illustrated embodiment, the scale 53 includes a 0° mark 55, 45° marks 56 and 90° marks 57. As will be obvious to those skilled in the art, any suitable angular scale markings may be utilized within the scope of the invention.

Angle scale plate 53 may be utilized in conjunction with any of the support means discussed above, including adjustable and fixed support means.

Thus, the invention permits producing an infinite number of bent tube arrangements on a repeatable basis without the need for premeasuring or marking the tubing. The tube stop means may be adjustably mounted on the support or permanently mounted thereto, as desired. The tube stop means may be removably secured to the mandrel, as desired. The tube stop means may be arranged not only to provide for positioning of the tube at a preselected distance from the bend start point but may also be utilized to provide positioning of preformed bends in the tube.

In use, the operator installs the tube T in the tube bender, as illustrated in FIG. 2, with the tube extending tangentially to the bending groove 12 at the bend start point 21.

As discussed above, the tube is positioned automatically relative to the bend start point 21 by abutment thereof with the positioning stop means illustrated in FIGS. 4–7. Thus, where the bend 47 is to be the first bend in the tube, the end of the tube 46 may be abutted with the stop means. Where the tube is provided with a preformed bend, the bend may be abutted with the stop means as illustrated in FIG. 6.

As further shown in FIG. 6, where a preformed bend is provided, the angular extent of the bend relative to the plane of the bending groove may be accurately effected by means of the angle scale 53.

The hook 23 is then swung into engagement with the tube to clamp the tube against extension portion 22 to lock the tube against longitudinal movement during the bending operation. During the installation of the tube, handle 17 is swung in a counterclockwise direction from the position of FIG. 2 to space the forming means 13 from the mandrel, permitting facilitated installation of the tube T. The handle 17 is then swung in a clockwise direction to the full line position of FIGS. 2 and 3 wherein link 15 abuts top pin 27.

Suitable manipulation of handles 17 and 18 is then effected to move the forming means 13 circumferentially about the mandrel to effect a bending of the tube into the groove 12 to the desired angular extent. Illustratively, as shown in broken lines in FIG. 2, the forming member may be swung approximately 90 degrees from the full line position thereof to effect a 90° bend in the tube T.

The foregoing disclosure of specific embodiments is illustrative of the broad inventive concepts comprehended by the invention.

I claim:

1. In a manually operable tube bender having a mandrel defining an arcuate tube-receiving bending groove extending arcuately about a bend axis from a bend start position, a forming member mounted to said mandrel to swing about said bend axis for urging a tube to be bent into said bending groove, and means for holding the tube against longitudinal displacement in said bending groove during a tube bending operation, the improvement comprising:

a support carried by the mandrel;

positioning means comprising a flat plate carried by the support defining a planar stop spaced from the bending groove bend start position at any one of a plurality of accurately preselected distances for abutment by selectively providing (a) a distal end of a straight tube portion to be bent therewith to accurately cause the bend to be spaced accurately from said distal end portion, and (b) by a bent end portion of a previously bent tube to be provided with a further bend spaced from said bent end end portion;

first scale means comprising a distance scale carried by said support;

second scale means comprising angular indicia means on said stop for indicating angular positions about the axis of the portion of the tube to be bent at said bend start position, whereby said bent end portion may be concurrently positioned in abutment with said stop and disposed in preselected angular relationship to the arcuate extent of the bending groove;

third scale means on said mandrel for indicating angular distances about said bend axis measured from said bend start position; and fourth scale means on the mandrel differing from said third scale means for indicating angular distances about said bend axis measured from said bend start position, said mandrel defining a front face and a rear face, said first scale means being provided on said front face and said second scale means being provided on said rear face.

2. The manually operable tube bender of claim 1 wherein said support is removably fixedly connected to the mandrel.

3. In a manually operable tube bender having a mandrel defining a tube-receiving bending groove extending arcuately about a bend axis from a bend start position, a forming member, means for mounting the forming member to said mandrel to swing about said bend axis for urging a tube to be bent into said bending groove, first scale means on said mandrel for indicating angular distances about said bend axis measured from said bend start position, and means for holding the tube against longitudinal displacement in said bending groove during a tube bending operation, the improvement comprising:

second scale means on the mandrel differing from said first scale means for indicating angular distances about said bend axis measured from said bend start position, said mandrel defining a front face and a rear face, said first scale means being provided on said front face and said second scale means being provided on said rear face;

first marker means associated with said forming member cooperating with said first scale means for indicating the angular disposition of the forming member relative to the bend start position; and second marker means associated with said forming member mounting means cooperating with said second scale means for indicating the angular disposition of the forming member relative to the bend start position whereby bending of tubing having a first bend previously formed therein may be effected by use of the scale means facing opposite to the direction of extension of the first bend for facilitated multiple bend formation.

4. The manually operable tube bender of claim 3 wherein said first scale has a greater angular extent than that of said second scale.

5. The manually operable tube bender of claim 3 wherein said first scale includes a greater number of angular indicators than that of said second scale.

6. The manually operable tube bender of claim 3 wherein said means for mounting said forming member comprises a link pivotally mounting said forming member to said mandrel.

7. In a manually operable tube bender having a mandrel defining a tube-receiving bending groove extending arcuately about a bend axis from a bend start position, a forming member, means for mounting the forming member to said mandrel to swing about said bend axis for urging a tube to be bent into said bending groove, first scale means on said mandrel for indicating angular distances about said bend axis measured from said bend start position, and means for holding the tube against longitudinal displacement in said bending groove during a tube bending operation, the improvement comprising:

second scale means on the mandrel differing from said first scale means for indicating angular distances about said bend axis measured from said bend start position, said mandrel defining a front face and a rear face, said first scale means being provided on said front face and said second scale means being provided on said rear face; and means associated with said forming member cooperating with said scales for indicating the angular disposition of the forming member relative to the bend start position, said means for mounting said forming member comprising a link pivotally mounting said forming member to said mandrel and defining an edge portion cooperating with said second scale for indicating the angular disposition of the forming member relative to the bend start position.

8. The manually operable tube bender of claim 7 further including an indicium on said forming member cooperating with said first scale for indicating the angular disposition of the forming member relative to the bend start position.

9. The manually operable tube bender of claim 7 wherein means are provided for preventing movement of the forming member from the bend start position in the direction opposite to the direction of extent of said scales therefrom whereby said forming member may be readily positioned at the bend start point without need for observation of the scales and said means associated with said forming member.

10. In a manually operable tube bender having means for bending a portion of a tube to different angular extents from a bend start position, the improvement comprising:

first indicating means for indicating the angular extent of the bent tube portion to a first position adjacent the tube bender; and second indicating means different from said first indicating means and functioning fully independently of said first scale means for indicating the angular extent of the bent tube portion to a user at a second position opposite the first position and adjacent the tube bender whereby bending of tubing having a first bend previously formed therein may be effected by use of the indicating means facing opposite to the direction of extension of the first bend for facilitated multiple bend formation.

11. The manually operable tube bender of claim 10 wherein said first indicating means faces oppositely to said second indicating means.

12. The manually operable tube bender of claim 10 wherein said first indicating means has a greater angular extent than that of said second indicating means.

13. The manually operable tube bender of claim 10 wherein said first indicating means has a greater number of angular indications than that of said second indicating means.

* * * * *

US004389872B1

REEXAMINATION CERTIFICATE (2531st)

United States Patent [19]

Kowal

[11] B1 4,389,872

[45] Certificate Issued Apr. 11, 1995

[54] TUBE BENDER CONSTRUCTION

[75] Inventor: Leonard J. Kowal, Prospect Heights, Ill.

[73] Assignee: The Pullman Company

Reexamination Request:
No. 90/003,364, Mar. 21, 1994

Reexamination Certificate for:

| | |
|---|---|
| Patent No.: | **4,389,872** |
| Issued: | **Jun. 28, 1983** |
| Appl. No.: | **229,862** |
| Filed: | **Jan. 30, 1981** |

[51] Int. Cl.[6] ..... B21D 7/02
[52] U.S. Cl. ..... 72/388; 72/36
[58] Field of Search ..... 72/32, 34, 36, 149, 72/217, 387, 388, 457, 458, 459, 461

[56] References Cited

U.S. PATENT DOCUMENTS

| | | | |
|---|---|---|---|
| 1,863,693 | 6/1932 | Mingori . | |
| 1,889,239 | 11/1923 | Crowley | 72/388 |
| 1,949,938 | 3/1934 | Martin . | |
| 2,455,138 | 11/1948 | Perkins | 72/32 |
| 2,464,800 | 3/1949 | Franck . | |
| 2,584,537 | 2/1952 | Benfield . | |
| 2,757,562 | 8/1956 | Zales et al. . | |
| 2,796,785 | 6/1957 | Philippe | 72/388 |
| 2,817,986 | 12/1957 | Benfield . | |
| 2,887,917 | 5/1959 | Kowal | 72/388 |
| 2,955,495 | 10/1960 | Stirling | 72/36 |
| 2,979,976 | 4/1961 | Franck . | |
| 3,194,038 | 7/1965 | Small et al. . | |
| 3,236,082 | 2/1966 | Beck et al. | 72/149 |
| 3,433,042 | 3/1969 | Crihfield | 72/217 |
| 3,557,586 | 1/1971 | Zmuda | 72/32 |
| 3,750,447 | 8/1973 | Kowal | 72/459 |
| 3,926,028 | 12/1975 | Kowal | 72/388 |

*Primary Examiner*—David B. Jones

[57] ABSTRACT

A tube bender construction for manual operation in bending a tube. The tube bender includes a mandrel defining a bending groove into which the tube is urged by a forming member mounted to the mandrel to swing about a bending axis of the bending groove. The tube to be bent is held against longitudinal movement during the bending operation by tube-holding structure arranged to clamp the tube against an extended groove portion of the mandrel. Movement of the forming member about the bending axis is effected by manipulation of a pair of handles which are arranged in offset manner to permit crossover of the handles and avoid interference between the user's hands thereon in the tube bending operation.

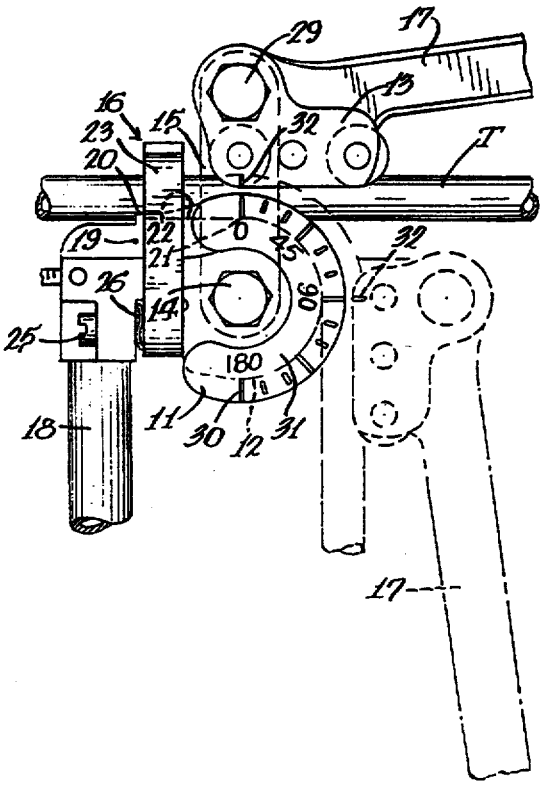

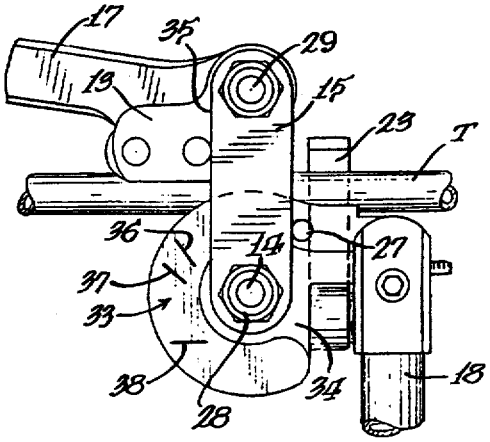

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–9 is confirmed.

Claim 10 is determined to be patentable as amended.

Claims 11–13 dependent on an amended claim are determined to be patentable.

10. In a manually operable tube bender having means for bending a portion of a tube to different angular extents from a bend start position, *the bent tube having a first bend in a direction of extension,* the improvement comprising:

first indicating means for indicating the angular extend of the bent tube portion to a first position adjacent the tube bender; and second indicating means different from said first indicating means and functioning fully independently of said first [scale] *indicating* means for indicating the angular extent of the bent tube portion to a user at a second position opposite the first position and adjacent the tube bender whereby bending of tubing having [a] *the* first bend previously formed therein may be effected by use of the *second* indicating means facing opposite to the direction of extension of the first bend for facilitated multiple bead formation.

* * * * *